US009348266B2

(12) United States Patent
Kakehi

(10) Patent No.: US 9,348,266 B2
(45) Date of Patent: May 24, 2016

(54) IMAGE FORMING APPARATUS USING PRESS MEMBER TO PREVENT DEFLECTION OF BELT

(71) Applicant: CANON KABUSHIKI KAISHA, Tokyo (JP)

(72) Inventor: Yutaka Kakehi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/693,287

(22) Filed: Apr. 22, 2015

(65) Prior Publication Data

US 2015/0309448 A1 Oct. 29, 2015

(30) Foreign Application Priority Data

Apr. 24, 2014 (JP) ..... 2014-090096

(51) Int. Cl.
*G03G 15/16* (2006.01)
*G03G 15/00* (2006.01)

(52) U.S. Cl.
CPC ..... *G03G 15/1605* (2013.01); *G03G 15/6567* (2013.01); *G03G 2215/0129* (2013.01)

(58) Field of Classification Search
CPC ..... G03G 15/161; G03G 15/1605; G03G 15/1615; G03G 15/1625; G03G 15/1665; G03G 15/167; G03G 2215/1625; G03G 2215/1623
USPC ..... 399/302, 308, 313
See application file for complete search history.

(56) References Cited

U.S. PATENT DOCUMENTS

| | | | | |
|---|---|---|---|---|
| 6,697,595 | B2 | 2/2004 | Kawagoe et al. | |
| 8,787,805 | B2 | 7/2014 | Nakajima | |
| 8,818,249 | B2 | 8/2014 | Kaseda | |
| 2009/0142083 | A1* | 6/2009 | Minbu | G03G 15/161 399/302 |
| 2010/0135681 | A1* | 6/2010 | Yanagi | G03G 15/6564 399/45 |
| 2011/0255909 | A1* | 10/2011 | Tomura | G03G 15/161 399/308 |
| 2012/0207522 | A1* | 8/2012 | Nakajima | G03G 15/1605 399/308 |
| 2013/0315612 | A1* | 11/2013 | Nishisaka | G03G 15/1605 399/302 |

FOREIGN PATENT DOCUMENTS

| | | | |
|---|---|---|---|
| JP | 2002-082543 | A | 3/2002 |
| JP | 2010-210805 | A | 9/2010 |
| JP | 2012-073537 | A | 4/2012 |
| JP | 2012-168396 | A | 9/2012 |

OTHER PUBLICATIONS

U.S. Appl. No. 14/672,469, filed Mar. 30, 2015, Haruhiko Omata.
U.S. Appl. No. 14/693,290, filed Apr. 22, 2015, Yutaka Kakehi.
U.S. Appl. No. 14/718,780, filed May 21, 2015, Yutaka Kakehi.

* cited by examiner

*Primary Examiner* — Sophia S Chen
(74) *Attorney, Agent, or Firm* — Fitzpatrick, Cella, Harper & Scinto

(57) ABSTRACT

An outer roller is provided at a position offset upstream, in a rotation direction of an image carrying belt, of an inner roller. The inner and outer rollers are provided across the image carrying belt and form a transfer nip portion nipping and conveying a recording medium. A press member presses the image carrying belt from an inner circumferential side at upstream of the inner roller. The press member is provided such that a length along a belt surface of the image carrying belt between a downstream end of a part thereof in contact with the image carrying belt and an upstream end of the transfer nip portion is shorter than a length of an end margin formed on an upstream end area of the recording medium.

12 Claims, 6 Drawing Sheets

IMAGE FORMING APPARATUS USING PRESS MEMBER TO PREVENT DEFLECTION OF BELT

BACKGROUND OF THE INVENTION

1. Field of the Invention

The present invention relates to an image forming apparatus forming a toner image on a recording medium by using an electro-photographic system.

2. Description of the Related Art

Hitherto, there is known an image forming apparatus configured to transfer a toner image carried on a rotating endless belt-like intermediate transfer body (referred to as an 'intermediate transfer belt' hereinafter) to a recording medium at a transfer nip portion in which the intermediate transfer belt is in contact with a transfer rotating body (a transfer belt or a transfer roller). An intense electric field is generated in the transfer nip portion because high voltage is applied to the transfer rotating body in order to transfer the toner image from the intermediate transfer belt to the recording medium.

By the way, there is a case when the intermediate transfer belt vibrates during its rotation. If the intermediate transfer belt vibrates, a gap is possibly generated between a toner image carrying surface of the intermediate transfer belt and a recording medium at upstream (upstream in a recording medium conveying direction) of the transfer nip portion. Because the intense electric field is generated at the transfer nip portion as described above, an abnormal discharge tends to occur between the intermediate transfer belt and the recording medium if the gap is generated at upstream of the transfer nip portion. If the abnormal discharge occurs, the electrical charge of the toner carried on the intermediate transfer belt drops or is lost and the toner whose electrical charge has dropped or has been lost is hardly transferred from the intermediate transfer belt to the recording medium. Then, a defective image in which an image of a spot where the abnormal discharge has occurred is omitted (called as a void or the like) tends to be generated.

Then, Japanese Patent Application Laid-open No. 2002-82543 discloses a device that suppresses the vibration of the intermediate transfer belt that otherwise causes the abnormal discharge by disposing a belt guide member (press member) on an inner circumferential surface (back surface side opposite to the toner image carrying surface) of the intermediate transfer belt to press the intermediate transfer belt from the back surface thereof and to bulge out the belt to the side of the transfer rotating body. This arrangement makes it possible to deliver the recording medium to the transfer nip portion in a state in which the recording medium is adhered to the toner image carrying surface of the intermediate transfer belt without gap at upstream of the transfer nip portion.

However, even if the press member pressing the intermediate transfer belt is provided, there is a case when the recording medium conveyed to the transfer nip portion pushes up the intermediate transfer belt to a side opposite to the bulge-out side by an end portion thereof upstream in the conveying direction. In such a case, the intermediate transfer belt deflects and a gap is generated between the intermediate transfer belt and the end portion upstream in the conveying direction of the recording medium, possibly causing a defective image due to the abnormal discharge as described above.

SUMMARY OF THE INVENTION

According to an aspect of the present invention, an image forming apparatus includes an endless image carrying belt rotating while carrying a toner image on a surface thereof, an inner roller provided on an inner circumferential side of the image carrying belt and being in contact with the image carrying belt, an outer roller provided on a side opposite from the inner roller across the image carrying belt at a position offset to upstream in a rotation direction of the image carrying belt from the inner roller and forming a transfer nip portion where a recording medium is nipped and conveyed, a power supply applying voltage between the inner and outer rollers to transfer the toner image from the image carrying belt to the recording medium conveyed through the transfer nip portion, and a press member provided upstream, in the rotation direction of the image carrying belt, of the inner roller and pressing the image carrying belt from the inner circumferential side of the belt, the press member configured such that a length along a belt surface of the image carrying belt between a downstream end of a part of the press member in contact with the image carrying belt and an upstream end of the transfer nip portion is shorter than a length of an end margin of the recording medium formed out of an image forming area and formed on an upstream end area of a surface of the recording medium in a recording medium conveying direction.

Further features of the present invention will become apparent from the following description of exemplary embodiments with reference to the attached drawings.

DESCRIPTION OF THE EMBODIMENTS

<First Embodiment>

An image forming apparatus of a first embodiment of the present invention will be described with reference to FIGS.1 through 4. At first, a schematic structure of the image forming apparatus of the present embodiment will be described with reference to FIG. 1.

<Image Forming Apparatus>

Figure 1:
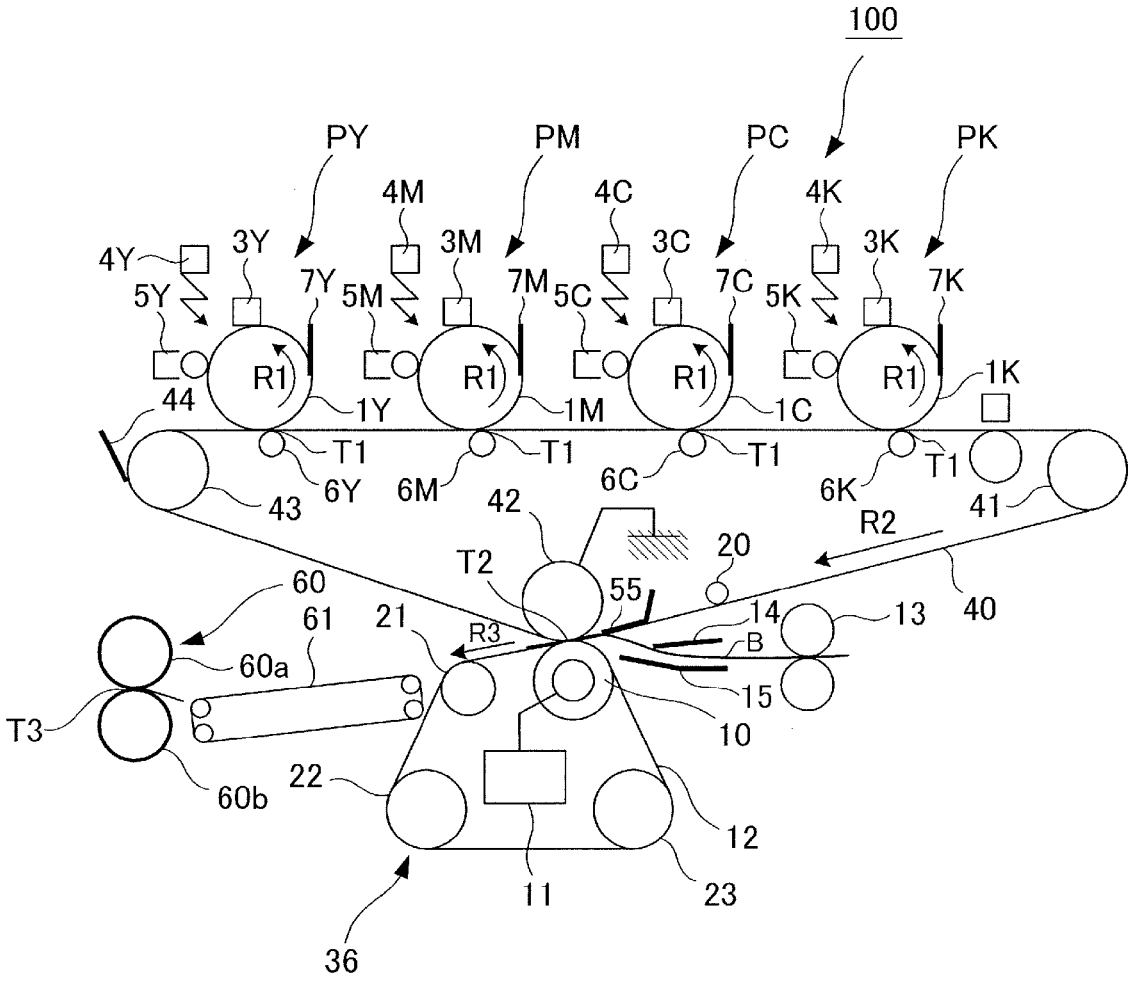
FIG. 1 is a schematic diagram illustrating a configuration of an image forming apparatus according to a first embodiment of the present invention.

The image forming apparatus 100 shown in FIG. 1 is a tandem intermediate transfer type full-color printer in which image forming portions PY, PM, PC and PK of yellow, magenta, cyan and black are arrayed along an intermediate transfer belt 40.

In the image forming portion PY, a yellow toner image is formed on a photosensitive drum 1Y, i.e., a photosensitive body, and is then transferred to an intermediate transfer belt (primary transfer). In the image forming portion PM, a magenta toner image is formed on a photosensitive drum 1M and is then transferred to the intermediate transfer belt 40 while superimposing on the yellow toner image. In the image forming portions PC and PK, cyan and black toner images are formed respectively on the photosensitive drums 1C and 1K and sequentially superimposed and transferred to the intermediate transfer belt 40.

The image forming portions PY, PM, PC and PK are constructed substantially in the same manner except that the toners used in developing apparatuses 5Y, 5M, 5C, and 5K are different as yellow, magenta, cyan and black. Therefore, the image forming portion PY will be mainly described below and an explanation of the image forming portions PM, PC and PK will be omitted.

In the image forming portion PY, a corona electrifier 3Y, a exposure apparatus 4Y, the developing apparatus 5Y, a primary transfer roller 6Y, and a drum cleaning device 7Y are disposed around the photosensitive drum 1Y. The photosensitive drum 1Y is provided with a photosensitive layer formed around an outer circumferential surface thereof and is rotated in a direction of an arrow R1 in FIG. 1 with a predetermined process speed.

The corona electrifier 3Y irradiates charged particles generated by corona discharge for example to a surface of the photosensitive drum 1Y to electrify with homogeneous negative dark part potential. The exposure apparatus 4Y draws an electrostatic latent image of an image on the surface of the electrified photosensitive drum 1Y by scanning, by a rotational mirror, an ON-OFF modulated laser beam of scan line image data developed from yellow color separation image. Because the electrostatic latent image drawn to the photosensitive drum 1Y by the exposure apparatus 4Y is an aggregate of small dot images, it is possible to change concentration of a toner image formed on the surface of the photosensitive drum 1Y by changing density of the dot images. For instance, maximum density of a toner image of each color is around 1.5 to 1.7 and a toner applied amount in the maximum density is around 0.4 to 1.6 mg/cm$^2$.

The developing apparatus 5Y supplies the toner to the photosensitive drum 1Y to develop the electrostatic latent image as a toner image. The developing apparatus 5Y rotates a developing sleeve (not shown) disposed, while leaving a slight gap, on the surface of the photosensitive drum 1Y in a counter direction of the photosensitive drum 1Y. The developing apparatus 5Y electrifies a two-component developer containing toner and carrier and conveys the developer to a part facing the photosensitive drum 1Y by carrying on the developing sleeve. Because vibration voltage in which AC voltage is superimposed on DC voltage is applied to the developing sleeve, the non-magnetic toner negatively electrified is transferred to an exposed part of the photosensitive drum 1Y which has become relatively positive. Then, the electrostatic latent image is reversely developed.

The primary transfer roller 6Y is in pressure contact with the intermediate transfer belt 40 and forms a primary transfer portion (nip) T1 between the photosensitive drum 1Y and the intermediate transfer belt 40. In response to a positive DC voltage applied to the primary transfer roller 6Y, the negatively electrified toner image on the photosensitive drum 1Y is transferred to the intermediate transfer belt 40. The toner images of the respective colors formed respectively in the image forming portions PY, PM, PC and PK are superimposed and transferred to the intermediate transfer belt 40 at the respective primary transfer nip portions T1. The primary transfer roller 6Y comes into contact with the intermediate transfer belt 40 with a total load of 10 N (1 kgf) for example and rotates following the rotation of the intermediate transfer belt 40. An elastic roller member in which an elastic layer of semi-conductive polyurethane foaming rubber is formed around a metallic shaft is used as the primary transfer roller 6Y. An Asker C hardness of a circumferential surface thereof is 10 and roller resistance is $1\times10^6\Omega$. The roller resistance of the primary transfer roller 6Y is calculated by placing weights of 500 g each on both ends of the metallic shaft of the primary transfer roller 6Y so as to press a metal plate earthed through an ampere meter to the primary transfer roller 6Y, applying a voltage of 2 kV to one end of the metallic shaft, and finding a current flowing through the metallic plate in an environment of 23° C. of temperature and 50% RH of relative humidity.

The cleaning device 7Y recovers transfer residual toner remaining on the surface of the photosensitive drum 1Y that has passed through the primary transfer portion T1 by bringing a cleaning blade into sliding contact with the surface of the photosensitive drum 1Y. The cleaning blade is made of a polyurethane material whose durometer A hardness is 70 and whose thickness is 2 mm.

<Intermediate Transfer Belt>

The intermediate transfer belt 40,i.e., an endless image carrying belt, is an endless belt-like intermediate transfer body rotating in contact with the photosensitive drums 1Y, 1M, 1C and 1K, and rotates in a direction of an arrow R2 in FIGS. 1 at 250 to 300 mm/sec. for example. The intermediate transfer belt 40 is made endlessly by using a resin material and is in contact with a tension roller 41, a secondary transfer inner roller 42, i.e., an inner roller, and a driving roller 43 respectively provided on an inner circumferential surface side thereof so as to be stretched by these rollers. For instance, a force pushing the intermediate transfer belt 40 from the back surface to the front surface thereof is applied to the tension roller 41 by an elastic member such as a spring (not shown) to stretch the intermediate transfer belt 40 by a tension of around 2 to 5kg. It is noted that the back surface of the intermediate transfer belt 40 refers to a surface on a side opposite to the surface carrying the toner image (toner image carrying surface) of the intermediate transfer belt 40, i.e., an inner circumferential surface.

The intermediate transfer belt 40 is an endless belt having a three-layered structure in which a resin layer, an elastic layer, and a surface layer are sequentially formed in order from the back surface side. For instance, a resin material such as polyamide, polycarbonate or the like is used to form the resin layer of 70 to 100 μm thick. An elastic material such as urethane rubber, chloroprene rubber or the like is used to form the elastic layer of 200 to 250 μm thick. A material whose toner adhesion power to the surface of the intermediate transfer belt 40 is small and which enables toner to be readily transferred to the recording medium B at a secondary transfer nip portion T2 (transfer nip portion) is used for the surface layer. For instance, either one resin material among polyurethane, polyester, epoxy resin and the like is used for the surface layer. Or, two or more types of elastic materials among elastic rubber, elastomer, butyl rubber and the like are used for the surface layer. In the case of using the elastic material, it is preferable to use a material which reduces surface energy and enhances lubrication, e.g., a material in which one or two or more types of powders, particles or what their particle sizes are differentiated of fluoro-resin are dispersed and blended. The surface layer is formed such that its thickness is 5 to 10 μm. Still further, volume resistivity of the intermediate transfer belt 40 is modified to $1\times10^9$ to $1\times10^{14}$ [Ω·cm] by adding a resistance value modifying conductive agent such as carbon black.

The registration roller 13 delivers the recording medium B to the secondary transfer nip portion T2, i.e., the transfer nip portion, while synchronizing with the toner image on the intermediate transfer belt 40. Disposed so as to face with each other along a conveying path to which the registration roller 13 delivers the recording medium B are upper and lower guides 14 and 15, i.e., a pair of guide members. That is, the upper and lower guides 14 and 15 are disposed while facing each other in a direction intersecting with a belt surface 40*a* (see FIG. 2 described later) of the intermediate transfer belt 40 at upstream in the recording medium conveying direction of the transfer nip portion T2. Then, the upper and lower guides 14 and 15 guide the recording medium B between them to the transfer nip portion T2. That is, the recording medium B is delivered between the upper and lower guides 14 and 15 and the upper and lower guides 14 and 15 restrict a moving direction of the recording medium B delivered by the registration roller 13. More specifically, the upper guide 14 restricts a move of the recording medium B approaching to the intermediate transfer belt 40 and the lower guide 15 restricts a move of the recording medium B separating from the intermediate transfer belt 40. This arrangement makes it possible to convey the recording medium B to the transfer nip portion T2 so as to run along the intermediate transfer belt 40. Thus, it is possible to suppress the recording medium B conveyed to the transfer nip portion T2 from coming into contact with the intermediate transfer belt 40 with unnecessary high pressure by restricting the recording medium B by the upper and lower guides 14 and 15.

The four color toner images carried on the intermediate transfer belt 40 are conveyed to the secondary transfer nip portion T2 and are collectively and secondarily transferred to the recording medium B at the secondary transfer nip portion T2. A secondary transfer belt 12 conveys and passes the recording medium B through the secondary transfer nip portion T2 while overlaying with the toner image on the intermediate transfer belt 40. The recording medium B on which the four color toner images have been secondarily transferred at the secondary transfer nip portion T2 is delivered from the secondary transfer nip portion T2 to a conveying belt 61. The conveying belt 61 guides the recording medium B delivered from the secondary transfer nip portion T2 to a fixing apparatus 60 while supporting a surface opposite to the surface on which the toner image has been transferred.

The fixing apparatus 60, i.e., a fixing portion, forms a fixing nip portion T3, i.e., a fixing nip portion, by bringing a heating roller 60*a* and a pressure roller 60*b*, i.e., two rotating bodies, into contact with each other and fixes the toner image on the recording medium B while conveying the recording medium B through the fixing nip T3. In the fixing apparatus 60, the fixing nip T3 is formed by bringing the pressure roller 60*b* into pressure contact with the heating roller 60*a* heated from inside thereof by a lamp heater or the like (not shown) by a bias mechanism (not shown). Heat and pressure are thus applied to the recording medium B and the toner image is fixed to the recording medium B which is conveyed while being nipped through the fixing nip T3. The recording medium B on which the toner image has been fixed by the fixing apparatus 60 is then discharged out of the apparatus.

The belt cleaning device 44 recovers transfer residual toner remaining on the intermediate transfer belt 40 that has passed through the secondary transfer nip portion T2 by bringing a cleaning blade in sliding contact with the intermediate transfer belt 40. The belt cleaning device 44 brings a tip of the cleaning blade made of polyurethane whose durometer A hardness is 75 and whose thickness is 2 mm into contact with the surface of the intermediate transfer belt 40 in a counter direction. Beside recovering the transfer residual toner on the intermediate transfer belt 40 that has passed through the secondary transfer nip portion T2 without being transferred to the recording medium B, the belt cleaning device 44 also removes paper dusts and others adhering from the recording medium B to the intermediate transfer belt 40 at the secondary transfer nip portion T2 out of the intermediate transfer belt 40.

<Secondary Transfer Belt Unit>

The secondary transfer belt unit 36 includes the secondary transfer belt 12, a secondary transfer roller 10, a stretch roller 21, a driving roller 22 and a tension roller 23. The secondary transfer belt 12, i.e., a transfer belt, comes in contact with the intermediate transfer belt 40 and forms the secondary transfer nip portion T2. Because a transfer electrical field is generated in the secondary transfer nip portion T2, the toner image on the intermediate transfer belt 40 is transferred to the recording medium B. The secondary transfer belt 12 is formed into a shape of an endless belt by using a high-resistant resin material and is stretched by the secondary transfer roller 10, the stretch roller 21, the driving roller 22, and the tension roller 23. The secondary transfer belt 12 rotates in a direction of an arrow R3 in FIG. 1 in synchronism with the intermediate transfer belt 40 and conveys the recording medium B delivered by the registration roller 13 and guided by the upper and lower guides 14 and 15 to the conveying belt 61 side by passing through the secondary transfer nip portion T2. The secondary transfer belt 12 adheres with the recording medium B by being electrified when the toner image on the intermediate transfer belt 40 is transferred to the recording medium B, separates the recording medium B carrying the non-fixed toner image from the intermediate transfer belt 40, and delivers to the conveying belt 61.

Figure 2:
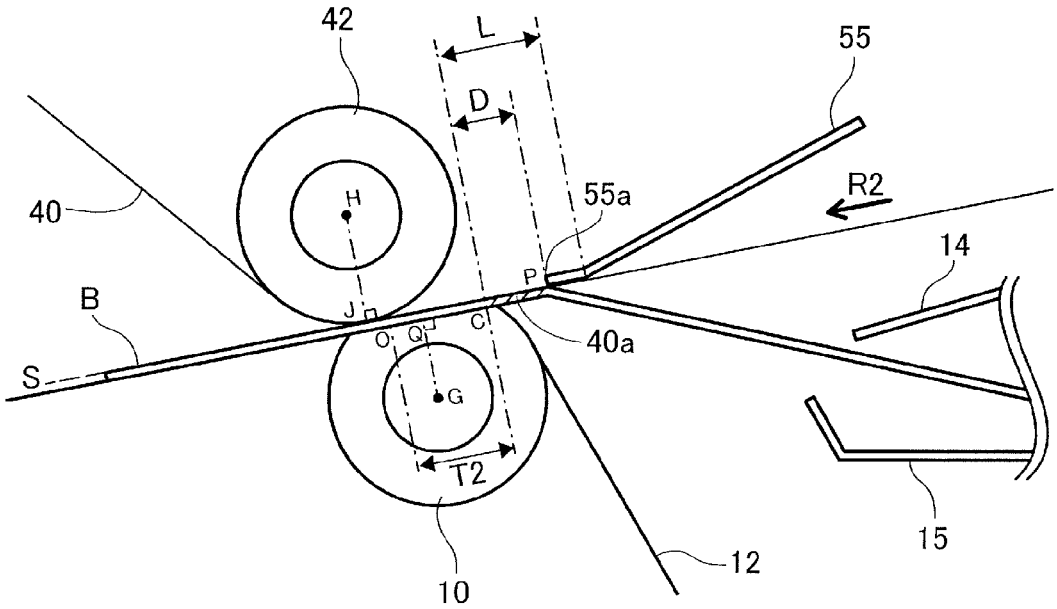
FIG. 2 is a schematic diagram illustrating a configuration around a secondary transfer nip portion of the first embodiment.

The secondary transfer roller 10, i.e., an outer roller, is provided at a position offset by 0 to 4 mm upstream, in the rotation direction of the intermediate transfer belt 40, of the secondary transfer inner roller 42. More specifically, as shown in FIG. 2 described later, the secondary transfer roller 10 is provided such that a first intersection point J is located downstream, in the rotation direction of the intermediate transfer belt 40, of a second intersection point Q. Here, The first intersection point J is an intersection point where a perpendicular line drawn from a center of rotation H of the secondary transfer inner roller 42 intersects with the tangential line S. The tangential line S is a tangential line that passes through a position where a press member 55 described later is in contact with the intermediate transfer belt 40 among tangential lines of the circumferential surface of the secondary transfer inner roller 42 in contact with the intermediate transfer belt 40. More specifically, it is a tangential line of the secondary transfer inner roller 42 connecting the position P where the press member 55 is in contact with the intermediate transfer belt 40 and a position (point O) where the secondary transfer inner roller 42 is in contact with the intermediate transfer belt 40 at upstream in the rotation direction of the intermediate transfer belt 40. The second intersection point Q is an intersection where a perpendicular line drawn from a center of rotation G of the secondary transfer roller 10 intersects with a tangential line S. The secondary transfer roller 10 is provided on a side opposite from the secondary transfer inner roller 42 across the secondary transfer belt 12 and the intermediate transfer belt 40 and forms the secondary transfer nip portion T2 by bringing the secondary transfer belt 12 in pressure contact with the intermediate transfer belt 40.

The secondary transfer roller 10 is an elastic roller in which an elastic layer of an ion conductive foaming rubber (NBR rubber) is formed around a metal shaft. An Asker C hardness of the outer circumferential surface of the secondary transfer roller 10 is 30 to 40, and a resistance value thereof is $1\times10^5$ to $1\times10^7\Omega$ when 2 kV is applied. This configuration is made so that the secondary transfer roller 10 can come into contact deformably with the secondary transfer inner roller 42 and the intermediate transfer belt 40. Therefore, the secondary transfer roller 10 is deformable corresponding to the bulge-out of the intermediate transfer belt 40 caused by the press member 55. It is noted that an outer diameter of the secondary transfer roller 10 is 24 mm for example and surface roughness thereof is 6.0 to 12.0 μm for example. Still further, a contact pressure of the secondary transfer roller 10 is approximately 50 N.

The secondary transfer roller 10 is connected with a secondary transfer high-voltage power supply 11 whose supply bias is variable as a power source applying voltage between the secondary transfer inner roller 42 and the secondary transfer roller 10. The transfer electric field is generated at the secondary transfer nip portion T2 by a positive voltage (secondary transfer voltage) whose polarity is reverse to that of the toner and applied to the secondary transfer roller 10 by the secondary transfer high-voltage power supply 11 while connecting the secondary transfer inner roller 42 to the ground potential (0 V). In response to this transfer electric field, the negative toner images of yellow, magenta, cyan, and black carried on the intermediate transfer belt 40 are transferred collectively and secondarily to the recording medium B. Then, the recording medium B is adsorbed to the secondary transfer belt 12 by static electricity generated in the secondary transfer belt 12 by the application of the secondary transfer voltage. The recording medium B adsorbed on the surface of the secondary transfer belt 12 is separated from the surface of the secondary transfer belt 12 by a curvature of a curved surface of the secondary transfer belt 12 along the stretch roller 21 provided downstream in the conveying direction of the recording medium B and is passed to the conveying belt 61.

<Press Member>

The image forming apparatus 100 of the present embodiment is provided with a press member 55 fixedly disposed upstream, in the rotation direction of the intermediate transfer belt 40, of the secondary transfer nip portion T2 to press the back surface of the intermediate transfer belt 40 such that the intermediate transfer belt 40 bulges out to its surface side (the toner image carrying surface side). The press member 55 is fixedly supported by a transfer unit frame (not shown) to which the tension roller 41, the secondary transfer inner roller 42 and the driving roller 43 stretching the intermediate transfer belt 40 are assembled and by a frame (not shown) of the image forming apparatus body through a first link member 81 (see FIG. 4) described later. The press member 55 will be explained below with reference to FIG. 2.

The press member 55 is formed by bending a plate-like member of a resin material such as polyester. For example, the press member 55 is formed into a plate of 0.4 to 0.6 mm thick and 330 to 380 mm of total width that enables the press member 55 to be totally in contact with the intermediate transfer belt 40 across a whole width thereof. In a case when the press member 55 is formed by using a sheet of PET (polyethylene terephthalate) resin, there is a possibility that an electric current flows through the press member 55, possibly causing defective transfer, along with the application of the secondary transfer voltage to the secondary transfer roller 10 if a PET resin sheet whose electric resistance is low. In contrary, if a PET resin sheet whose electric resistance is high is adopted, there is a possibility that static electricity (frictional electrification) is generated by friction between the press member 55 and the intermediate transfer belt 40 and the intermediate transfer belt 40 is adsorbed to the press member 55, possibly interfering the rotation of the intermediate transfer belt 40. Then, as the press member 55, it is preferable to adopt a PET resin sheet which has been adjusted to have a medium range electric resistance in advance.

The press member 55 causes the recording medium B to be conveyed to adhere with the intermediate transfer belt 40 by bringing a plate-like part of the press member 55 into contact with the intermediate transfer belt 40 and by pressing the intermediate transfer belt 40 at upstream of the secondary transfer nip portion T2 (upstream in the conveying direction of the recording medium B). To that end, the press member 55 is disposed such that an intrusion amount thereof to the intermediate transfer belt 40 is determined in advance so that a gap is hardly generated between the recording medium B and the intermediate transfer belt 40. The intrusion amount corresponds to a displacement length from the stretched surface of the intermediate transfer belt 40 in a case not pressed by the press member 55 to the stretched surface of the intermediate transfer belt 40 in a case pressed by the press member 55. Specifically, the press member 55 is disposed at any position bulging out the stretched surface of the intermediate transfer belt 40 to the surface side (the toner image carrying surface side) by 1.0 to 3.0 mm for example. Still further, more specifically, the press member 55 is disposed at a predetermined position in terms of the rotation direction of the intermediate transfer belt 40 as described later. Then, the press member 55 is disposed in a direction not interfering the rotation of the intermediate transfer belt 40, or such that the front end 55*a* of the press member 55 orients downstream in the rotation direction of the intermediate transfer belt 40. Thereby, the press member 55 comes into contact with the intermediate transfer belt 40 in a forward direction in the rotation direction R2.

By the way, it is preferable to increase the intrusion amount of the press member 55 in transferring a toner image to a recording medium B whose surface irregularity is large. The recording medium B comes into contact with the intermediate transfer belt 40 with high pressure if the intrusion amount of the press member 55 is increased, so that the irregularities on the surface of the recording medium B on the side in contact with the intermediate transfer belt 40 is smoothed and voids are hardly generated as a result.

However, if the intermediate transfer belt 40 is bulged out to a side of the secondary transfer roller 10 by the press member 55, the recording medium B comes into contact with the intermediate transfer belt 40 with high pressure as compared to a case when no press member 55 is provided. Then, if the recording medium B comes into contact with the intermediate transfer belt 40 with excessively high pressure, a defective image (roughness for example) other than the void tends to be generated. Then, in order to prevent the recording medium B from coming into contact with the intermediate transfer belt 40 with the unnecessarily high pressure, the recording medium B is conveyed so as to run along the intermediate transfer belt 40 by guiding the recording medium B by the upper and lower guides 14 and 15.

Figure 3:
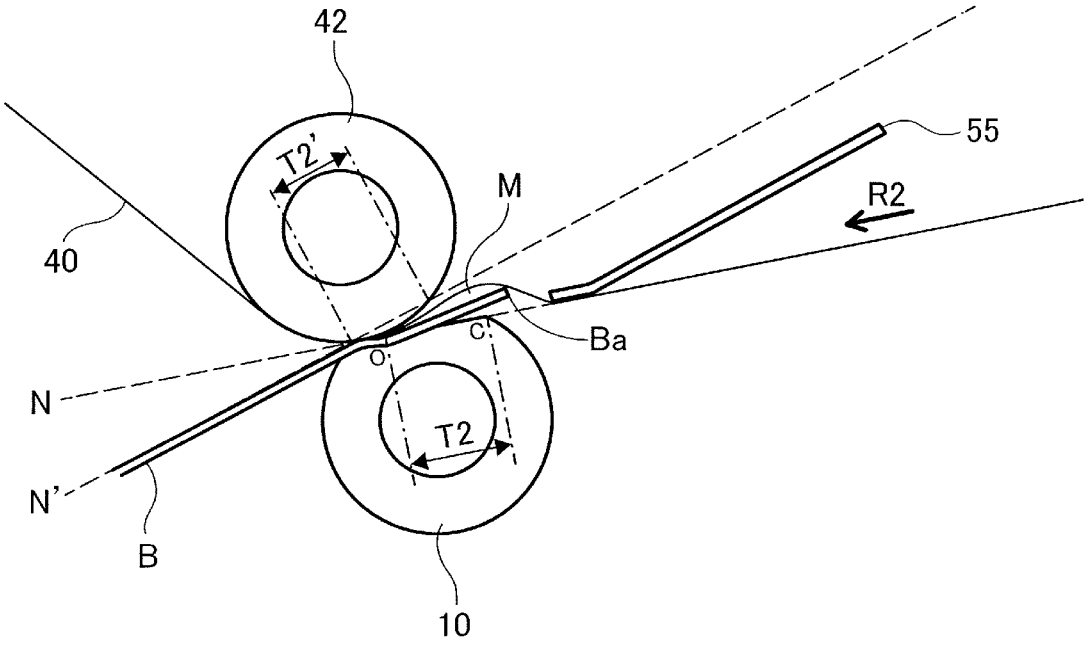
FIG. 3 is a schematic diagram illustrating a principle of occurrence of a defective image caused by abnormal discharge.

However, there is a problem that the larger the intrusion amount of the press member 55, the more easily a gap tends to be generated between the recording medium B and the intermediate transfer belt 40 when the recording medium B passes through the upper and lower guides 14 and 15. This problem will be described with reference to FIG. 3. FIG. 3 is a schematic diagram illustrating a principle how a defective image is generated by abnormal discharge. In FIG. 3, the secondary transfer belt 12 is omitted as compared to the configuration shown in FIG. 2.

As shown in FIG. 3, when the intermediate transfer belt 40 is pressed by the press member 55, a nip line N of the secondary transfer nip portion T2 is formed to a side closer to a center of the rotation of the secondary transfer roller 10 than a nip line N' in the case when no press member 55 is provided. In this case, if the upstream side (rear end side) in the conveying direction of the recording medium B enters the secondary transfer nip portion T2 while being restricted by the upper and lower guides 14 and 15 as shown in FIG. 2, the recording medium B will not push up the intermediate transfer belt 40 unnecessarily and the recording medium B is hardly separated from the intermediate transfer belt 40. That is, the recording medium B is pressed by the intermediate transfer belt 40 and the state in which the recording medium B is in contact with the intermediate transfer belt 40 is maintained upstream of the secondary transfer nip portion T2. Accordingly, a gap which otherwise causes the abnormal discharge is hardly generated and voids are hardly generated. It is noted that the nip line N' in the case when no press member 55 is provided as shown in FIG. 3 is formed in a direction substantially perpendicular to a line (not shown) connecting centers of rotations of the secondary transfer roller 10 and the secondary transfer inner roller 42. The secondary transfer roller 10 is disposed at the position offset upstream in the rotation direction of the intermediate transfer belt 40 with respect to the secondary transfer inner roller 42 as described above. Due to that, the nip line N' in the case when no press member 55 is provided takes an angle inclining in a direction in which an upstream side thereof separates from the secondary transfer roller 10.

Here, the upstream end in the conveying direction (the last end) Ba of the recording medium B passes through the upper and lower guides 14 and 15 as shown in FIG. 3, the recording medium B tries to keep a posture that runs substantially along the nip line N'. Then, as shown in FIG. 3, the recording medium B pushes up the intermediate transfer belt 40 in a direction opposite to the bulge-out of the intermediate transfer belt 40, i.e., to the nip line N' side, by the last end Ba (more specifically a rear edge). In particular, a force that pushes up the intermediate transfer belt 40 strongly acts in such cases when the press member 55 bulges out the intermediate transfer belt 40 largely, the nip line N' is separated largely from the nip line N, and the recording medium B is a recording medium whose bending rigidity is high such as a thick sheet, a coated sheet or the like. Then, if the intermediate transfer belt 40 is uplifted and is deflected by the last end Ba of the recording medium B, a gap M is generated between the intermediate transfer belt 40 and the recording medium B in a vicinity upstream of the secondary transfer nip portion T2. As a result, the abnormal discharge is generated and the voids tend to be generated at such part where the gap is generated as described above. It is noted that the recording medium B whose bending rigidity is high includes a thick sheet, a coated sheet, and an OHP sheet whose basis weight is 82 g/m$^2$ or more.

Here, in order to solve the abovementioned problem that the defective image is generated when the last end Ba of the recording medium B passes through the upper and lower guides 14 and 15, according to the present embodiment, the press member 55 is disposed at a position as described below. That is, as shown in FIG. 2, the press member 55 is disposed such that a distance D between a position P where a front end 55a of the press member 55 is in contact with the intermediate transfer belt 40 and an inlet C which is a position of an upstream end of the secondary transfer nip portion T2 where the intermediate transfer belt 40 comes into contact with the secondary transfer belt 12 falls within a rear end margin, i.e., an end margin L of the recording medium B. In other words, the distance D is a length along a belt surface 40*a* of the intermediate transfer belt 40 between a downstream end (the front end 55*a*) of a part where the press member 55 is in contact with the intermediate transfer belt 40 and the upstream end of the secondary transfer nip portion T2 in terms of the rotation direction of the intermediate transfer belt 40. The rear end margin L is a length of a margin out of an image forming area of the upstream end of the surface of the recording medium B in terms of the conveying direction of the recording medium B. Then, the press member 55 is provided such that the distance D is shorter than the rear end margin L. Here, the following equation 1 expresses a relationship between the distance D and the rear end margin L:

$$D \leq L \qquad \text{Eq. 1}$$

Thus, the press member 55 is provided so as to press the intermediate transfer belt 40 within a range from the inlet C of the secondary transfer nip portion T2 and the rear end margin L of the recording medium B. Here, the margin of the recording medium B is out of an image forming area on the surface of the recording medium B. The image forming area is an area in which an image can be formed by the apparatus on the surface of the recording medium B. A maximum area in which an image can be formed by the apparatus will be referred to as a maximum image forming area. In particular, a margin formed out of the image forming area and formed on the upstream end area of the surface of the recording medium B, i.e., the margin formed upstream the image forming area of the surface of the recording medium B in the recording medium conveying direction, will be referred to as a rear end margin. This rear end margin is set in advance as a minimum margin or the like out of the maximum image forming area of a product specification per type of the image forming apparatus 100. While a length in the recording medium conveying direction of the rear end margin depends on the type of the image forming apparatus 100, it is around 1 to 4 mm (1 mm or more and 4 mm or less) for example. The length of the margin is not limited to that, of course, and a user may adequately set the rear end margin in accordance to size of the recording medium B. It is noted that the image forming area of the recording medium B is also an area in which the toner images are formed on the photosensitive drums 1Y, 1M, 1C and 1K, i.e., an area in which a latent images are formed.

Meanwhile, the press member 55 possibly obstructs the drive of the secondary transfer inner roller 42 if the press member 55 is disposed such that the front end 55*a* is positioned at the position O where the intermediate transfer belt 40 comes into contact with the secondary transfer inner roller 42 within the secondary transfer nip portion T2. Because the secondary transfer inner roller 42 has the function of stretching the intermediate transfer belt 40, the intermediate transfer belt 40 cannot be smoothly driven if the drive of the secondary transfer inner roller 42 is obstructed. In such a case, there is a possibility that the toner image deviates from a predetermined position in conducting the primary and secondary transfer operations. Still further, if the press member 55 is disposed such that the front end 55*a* is positioned at the inlet C of the secondary transfer nip portion T2, the press member 55 possibly obstructs the drive of the secondary transfer roller 10. In view of these circumstances, the press member 55 is disposed such that the front end 55*a* of the press member 55 is positioned at upstream in the rotation direction of the intermediate transfer belt 40 of the inlet C of the secondary transfer portion nip T2.

COMPARATIVE EXAMPLE

Table 1 below shows evaluation results of images formed by using the image forming apparatus 100 of the present embodiment of the invention. Here, an experiment has been carried out so as to find whether or not voids are present when the distance D between the positions P and C described above is changed by using a plurality of image forming apparatuses 100 whose setting of rear end margins (L) are different as 2.0 mm, 2.5 mm and 3.0 mm. In Table 1, cases when voids were seen (conspicuous) on recording mediums are indicated by 'x' and cases when no void is seen on recording mediums (not conspicuous) are indicated by 'O':

TABLE 1

| | void | | |
|---|---|---|---|
| D(mm) | L = 2.0 mm | L = 2.5 mm | L = 3.0 mm |
| 1.0 | ○ | ○ | ○ |
| 1.5 | ○ | ○ | ○ |
| 2.0 | ○ | ○ | ○ |
| 2.5 | x | ○ | ○ |
| 3.0 | x | x | ○ |
| 3.5 | x | x | x |

As it is apparent from Table 1, in the case when the rear end margin L was 2.0 mm, no void was conspicuous when the distance D was 2.0 mm or less and voids were conspicuous when the distance D was 2.5 mm or more. In the case when the rear end margin L was 2.5 mm, no void was conspicuous when the distance D was 2.5 mm or less and voids were conspicuous when the distance D was 3.0 mm or more. In the case when the rear end margin L was 3.0 mm, no void became apparent when the distance D was 3.0 mm or less and voids were conspicuous when the distance D was 3.5 mm or more. It can be seen from this experimental result that the distance D by which no void is conspicuous expands in proportion to the rear end margin L. That is, voids are hardly conspicuous so long as the abnormal discharge is generated in the range in which the distance D is less than the rear end margin L.

Then, according to the image forming apparatus 100 of the present embodiment, an arrangement is made so that the range in which the abnormal discharge possibly occurs falls within the rear end margin L out of the image forming area of the recording medium B by disposing the press member 55 such that the Equation 1 "distance D≤rear end margin L" is met. Thereby, the length D of the belt surface 40*a* of the intermediate transfer belt 40 between the front end 55*a* of the press member 55 and the secondary transfer nip portion T2, i.e., the inlet C of the secondary transfer nip portion T2, becomes shorter than the rear end margin L of the recording medium B as shown in FIG. 2. That is, a range in which the last end Ba of the recording medium B possibly uplifts the intermediate transfer belt 40 and generates a gap M is substantially a range from the inlet C of the secondary transfer nip portion T2 to the position P where the front end 55*a* of the press member 55 comes into contact with the intermediate transfer belt 40. Accordingly, an abnormal discharge is possibly generated between the recording medium B and the intermediate transfer belt 40 within this range when the last end Ba of the recording medium B passes through the upper and lower guides 14 and 15 (see FIG. 3). However, because the length of this range from the inlet C of the secondary transfer nip portion T2 is shorter than the rear end margin L of the recording medium B, the range in which the abnormal discharge tends to be generated falls within the rear end margin L of the recording medium B. Because the rear end margin L is an area where no toner image is formed, no void is generated even if the abnormal discharge is generated in this area. Accordingly, even if the intermediate transfer belt 40 is uplifted by the recording medium B and the gap M is generated, a defective image such as void is hardly conspicuous on the recording medium in the present embodiment.

Figure 4:
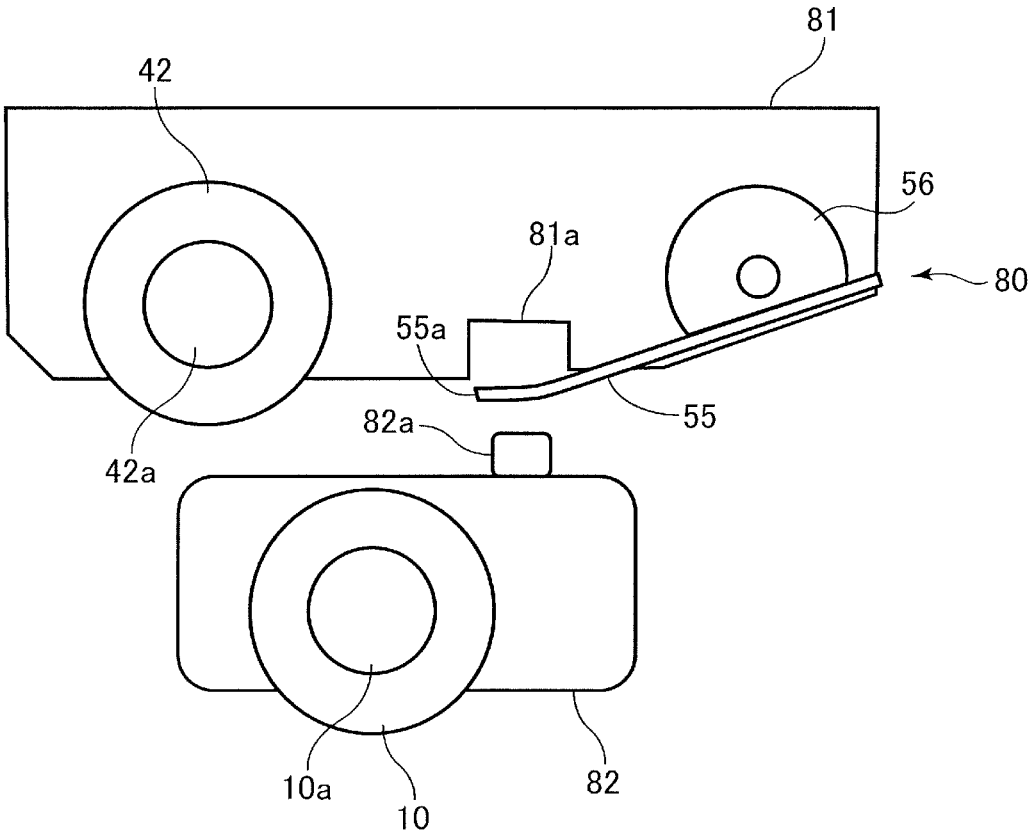
FIG. 4 is a schematic diagram illustrating a configuration supporting an inner roller, a press member, and an outer roller.

By the way, in a case when a sheet-like press member 55 formed of a PET resin sheet is used, the front end 55*a* of the press member 55 gradually wears due to friction with the intermediate transfer belt 40 even if the press member 55 is provided so as to come into contact with the intermediate transfer belt 40 in a forward direction of the rotation direction of the intermediate transfer belt 40. If the wear of the press member 55 advances, the function of pressing the intermediate transfer belt 40 drops, so that it is desirable for the user to replace the worn press member 55 with a new one. However, the positional relationship of the press member 55, the secondary transfer inner roller 42 and the secondary transfer roller 10 is restricted as described above in the image forming apparatus 100 of the present embodiment. Therefore, it is difficult for the user to adequately dispose the press member 55 at the position meeting the Equation 1 "distance D≤rear end margin L" described above by merely replacing only the press member 55. Then, according to the present embodiment, it is arranged such that the user can readily replace the press member 55 while adequately controlling the positional relationship between the press member 55 and the secondary transfer inner roller 42 and also the press member 55 and the secondary transfer roller 10. This arrangement will be described below by using FIG. 4. FIG. 4 is a side view showing a supporting structure of the secondary transfer inner roller 42, the press member 55, and the secondary transfer roller 10 seen from a front side of the image forming apparatus shown in FIG. 1.

As shown in FIG. 4, the press member 55 and the secondary transfer inner roller 42 are linked by a plate-like first link member 81, i.e., a support member, at an end part in a rotational axial direction of the secondary transfer inner roller 42 and are constructed as one secondary transfer counter unit 80. The press member 55 is provided with an attachment member 56 at a base end part on a side opposite from the front end 55*a* pressing the intermediate transfer belt 40 and the press member 55 is removably attached to a first link member 81 through the attachment member 56. The secondary transfer inner roller 42 is rotatably attached to the first link member 81 through a shaft 42*a*. The press member 55 and the secondary transfer inner roller 42 are attached to the first link member 81 so that they take the predetermined positional relationship within the secondary transfer counter unit 80. That is, the first link member 81 supports the secondary transfer inner roller 42 and the press member 55 while keeping the mutual positional relationship and such that the press member 55 is removable. The predetermined positional relationship here is a positional relationship by which the press member 55 is located at the position meeting with the abovementioned equation "distance D≤rear end margin L" when the first link member 81 is fitted with the second link member 82 as described below and mounted to the apparatus body.

The first link member 81 is provided with a concave portion 81*a* to which a convex portion 82*a* of the second link member 82 can be fitted. The secondary transfer roller 10 is rotatably supported by the second link member 82, i.e., a positioning member, through a shaft 10*a*. Then, the second link member 82 is positioned with respect to the first link member 81 by fitting the concave portion 81*a* with the convex portion 82*a*. Then, the secondary transfer roller 10 supported by the second link member 82 is positioned with respect to the secondary transfer inner roller 42 supported by the first link member 81. Specifically, the secondary transfer roller 10 and the secondary transfer inner roller 42 are provided in the first link member 81 and the second link member 82 so that the secondary transfer roller 10 is in contact with the secondary transfer inner roller 42 across the intermediate transfer belt 40. The mutual positional relationship of the secondary transfer inner roller 42 and the press member 55 supported by the first link member 81 is kept as described above. Therefore, the secondary transfer inner roller 42, the press member 55 and the secondary transfer roller 10 are disposed so as to meet the abovementioned relationship by positioning the second link member 82 with respect to the first link member 81 as described above.

In the case of replacing the press member 55, the first link member 81 is taken out of the apparatus body, the press member 55 is detached from the first link member 81, and a new press member 55 is attached to the first link member 81. Then, the first link member 81 from which the press member 55 is replaced is disposed within the apparatus body so that the concave portion 81*a* fits with the convex portion 82*a* of the second link member 82. Thereby, the user can smoothly replace the press member 55 while reducing a workload. At this time, the mutual position of the secondary transfer roller 10 and the secondary transfer inner roller 42 is defined when they are brought into contact with each other across the intermediate transfer belt 40. Still further, because the positional relationship of the secondary transfer inner roller 42 with the press member 55 is defined by the first link member 81, the positional relationship of the press member 55 with the secondary transfer roller 10 is also kept. Accordingly, the user can readily replace the press member 55 while adequately controlling the positional relationship between the press member 55 and the secondary transfer inner roller 42 and the positional relationship between the press member 55 and the secondary transfer roller 10.

<Second Embodiment>

Figure 5:
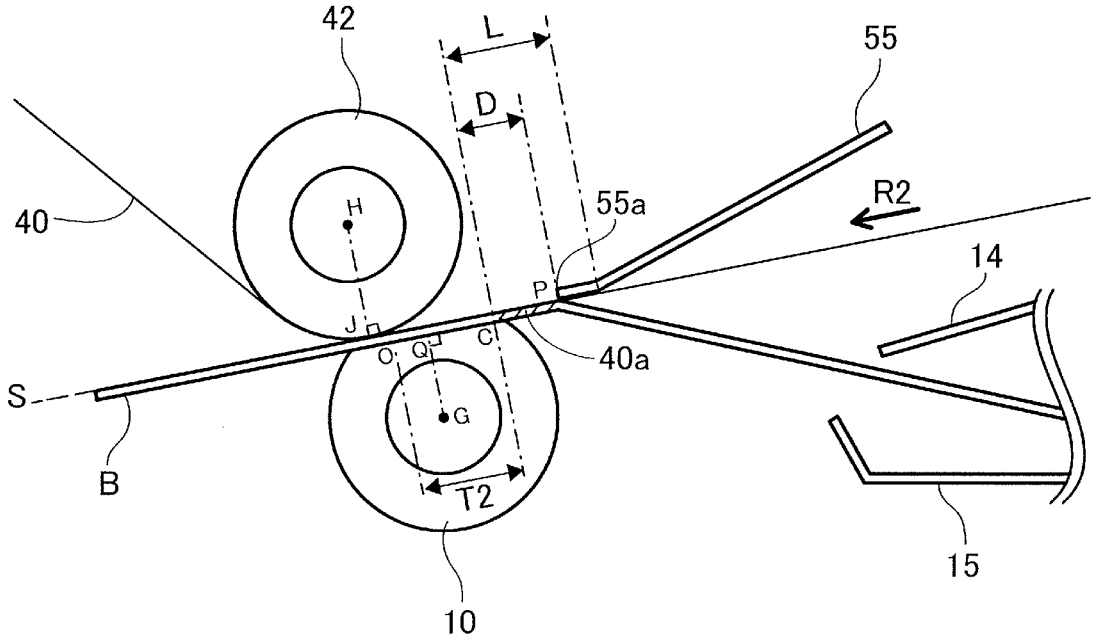
FIG. 5 is a schematic diagram illustrating a configuration around a secondary transfer nip of a second embodiment.

A second embodiment of the present invention will be described with reference to FIG. 5. In the first embodiment described above, the configuration forming the secondary transfer nip portion T2 between the intermediate transfer belt and the secondary transfer belt 12 has been described. However, the secondary transfer nip portion T2 is formed by bringing the secondary transfer roller 10 into direct contact with the intermediate transfer belt 40 without using the secondary transfer belt 12 in the present embodiment. The secondary transfer roller 10 is disposed by being offset at upstream with respect to the secondary transfer inner roller 42 also in the present embodiment. Due to that, there is a possibility that a defective image such as voids occurs at an upstream end portion of the recording medium B similarly to the first embodiment. Therefore, the position of the press member 55 is restricted in the same manner with that of the first embodiment also in the present embodiment. The other configurations and operations are the same with those of the first embodiment.

<Third Embodiment>

Figure 6:
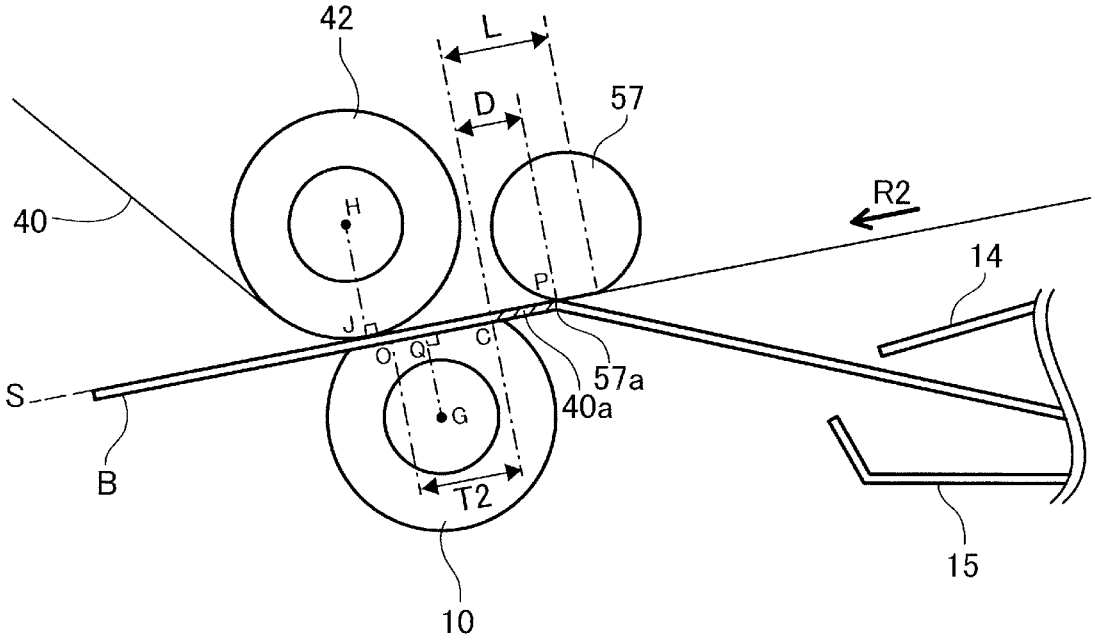
FIG. 6 is a schematic diagram illustrating a configuration around a secondary transfer nip of a third embodiment.

A third embodiment of the present invention will be described with reference to FIG. 6. The member formed into the plate-like shape has been used as the press member in the first and second embodiments described above. However, a roller 57 is used as the press member in the present embodiment. The roller 57 is a resin-made roller for example which has been adjusted to have a middle electric resistance in advance as what described in the first embodiment. It is noted that the roller 57 may be what the electric resistance is adjusted to the middle resistance by providing a thin elastic layer on a surface of a metallic roller. Still further, the roller 57 may be configured to be unrotatable or to be rotatable following the intermediate transfer belt 40.

In the case of the present embodiment, a surface of the roller 57 pressing the intermediate transfer belt 40 comes into contact with the intermediate transfer belt 40 with a predetermined length along the rotation direction of the intermediate transfer belt 40. In this case, the roller 57 is disposed such that a distance D between a position P where a downstream end 57*a* of a contact part of the roller 57 comes into contact with the intermediate transfer belt 40 and the inlet C which is the position of the upstream end of the secondary transfer nip portion T2 falls within the rear end margin L of the recording medium B. In other words, the distance D is a length, in terms of the rotation direction of the intermediate transfer belt 40, along the belt surface 40*a* of the intermediate transfer belt 40 between the downstream end 57*a* of the part of the roller 57 in contact with the intermediate transfer belt 40 and the upstream end of the secondary transfer nip portion T2. The rear end margin L is a length of a margin, i.e., out of an image forming area at the upstream end part on the surface of the recording medium B in terms of the conveying direction of the recording medium B. Then, the roller 57 is provided such that the distance D is shorter than the rear end margin L. The other configurations and operations of the present embodiment are the same with those of the second embodiment. It is noted that the configuration of the present embodiment may be applied to the configuration including the secondary transfer belt 12 similarly to the first embodiment.

<Other Embodiment>

The image forming apparatus described in each embodiment described above is a copier, a printer, a facsimile, a multi-function printer, or the like. The image forming apparatus of each embodiment described above can be carried out regardless a tandem type or a one-drum type, a charging system, an electrostatic image forming system, a developing system, a transfer system, and a fixing system as long as the image forming apparatus uses the intermediate transfer belt.

Still further, the image forming apparatus is not limited to be a horizontal conveying type in which the recording medium B is conveyed substantially in a horizontal direction with respect to a grounding surface of the apparatus body and may be a vertical conveying type in which the recording medium B is conveyed substantially in a vertical direction with respect to the grounding surface of the apparatus body as shown in FIG. 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-090096, filed Apr. 24, 2014, which is hereby incorporated by reference herein in its entirety.

What is claimed is:

1. An image forming apparatus comprising:

an endless image carrying belt rotating while carrying a toner image on a surface thereof;

an inner roller provided on an inner circumferential side of the image carrying belt and being in contact with the image carrying belt;

an outer roller, provided on a side opposite from the inner roller across the image carrying belt, forming a transfer nip portion, with the inner roller, where a recording medium is nipped and conveyed;

a power supply applying voltage between the inner and outer rollers to transfer the toner image from the image carrying belt to the recording medium conveyed through the transfer nip portion; and a press member provided upstream, with respect to a rotation direction of the image carrying belt, of the inner roller, and pressing the image carrying belt from the inner circumferential side of the image carrying belt at a position closer to the outer roller side than a first imaginary line, which is orthogonal to a second imaginary line connecting a center of rotation of the inner roller and a center of rotation of the outer roller, and passes through the transfer nip portion, the press member being configured such that a length along a surface of the image carrying belt between a downstream end of a part of the press member in contact with the image carrying belt and an upstream end of the transfer nip portion is shorter than a length of a rear end margin formed out of an image forming area and formed on an upstream end area of a surface of the recording medium with respect to a recording medium conveying direction.

2. The image forming apparatus according to claim 1, wherein the outer roller is provided such that a first intersection point where a perpendicular line drawn from the center of rotation of the inner roller intersects with a tangential line that passes through a position where the press member is in contact with the image carrying belt among tangential lines of the circumferential surface of the inner roller in contact with the image carrying belt is located downstream, with respect to the rotation direction of the image carrying belt, of a second intersection point where a perpendicular line drawn from the center of rotation of the outer roller intersects with the tangential line that passes through the position where the press member is in contact with the image carrying belt.

3. The image forming apparatus according to claim 1, further comprising an endless transfer belt that comes into contact with the image carrying belt, wherein the outer roller is provided on a side opposite from the inner roller across the transfer belt and the image carrying belt, and forms the transfer nip portion by bringing the transfer belt in pressure contact with the image carrying belt.

4. The image forming apparatus according to claim 1, wherein the outer roller is an elastic roller including an elastic layer and forms the transfer nip portion by coming into direct contact with the image carrying belt.

5. The image forming apparatus according to claim 1, wherein the press member presses the image carrying belt by bringing a plate-like part thereof into contact with the image carrying belt.

6. The image forming apparatus according to claim 1, wherein the press member is a roller.

7. The image forming apparatus according to claim 1, wherein the length of the rear end margin of the recording medium is a length of a minimum margin set in advance.

8. The image forming apparatus according to claim 1, wherein the length of the rear end margin of the recording medium is 1 mm or more and 4 mm or less.

9. The image forming apparatus according to claim 1, further comprising a pair of guide members disposed to face each other in a direction intersecting with the belt surface upstream, with respect to the recording medium conveying direction, of the transfer nip portion and guiding the recording medium therebetween to be conveyed to the transfer nip portion.

10. The image forming apparatus according to claim 1, further comprising a support member supporting the inner roller and the press member while keeping a mutual positional relationship of the inner roller and the press member, and removably supporting the press member.

11. The image forming apparatus according to claim 10, further comprising a positioning member supporting the outer roller and positioning the outer roller with respect to the inner roller supported by the support member by being positioned with respect to the support member.

12. An image forming apparatus comprising:

an endless image carrying belt rotating while carrying a toner image on a surface thereof;

an inner roller provided on an inner circumferential side of the image carrying belt and being in contact with the image carrying belt;

an outer roller, provided on a side opposite from the inner roller across the image carrying belt, forming a transfer nip portion, with the inner roller, where a recording medium is nipped and conveyed;

a power supply applying voltage between the inner and outer rollers to transfer the toner image from the image carrying belt to the recording medium conveyed through the transfer nip portion; and a press member provided upstream, with respect to a rotation direction of the image carrying belt, of the inner roller, and pressing the image carrying belt from the inner circumferential side of the image carrying belt at a position closer to the outer roller side than a first imaginary line, which is orthogonal to a second imaginary line connecting a center of rotation of the inner roller and a center of rotation of the outer roller, and passes through the transfer nip portion, the press member being configured such that a length along a surface of the image carrying belt between a downstream end of a part of the press member in contact with the image carrying belt and an upstream end of the transfer nip portion is shorter than 1 mm.

* * * * *